US011205879B2

(12) United States Patent
Perraud et al.

(10) Patent No.: US 11,205,879 B2
(45) Date of Patent: Dec. 21, 2021

(54) ELECTRICAL SOCKET CONNECTOR AND VEHICLE COMPRISING THIS ELECTRICAL SOCKET CONNECTOR

(71) Applicant: VOLVO TRUCK CORPORATION, Gothenburg (SE)

(72) Inventors: Nicolas Perraud, Genas (FR); Yann Quibriac, Lyons (FR)

(73) Assignee: VOLVO TRUCK CORPORATION, Gothenburg (SE)

( * ) Notice: Subject to any disclaimer, the term of this patent is extended or adjusted under 35 U.S.C. 154(b) by 0 days.

(21) Appl. No.: 16/771,341

(22) PCT Filed: Dec. 11, 2017

(86) PCT No.: PCT/IB2017/001735
§ 371 (c)(1),
(2) Date: Jun. 10, 2020

(87) PCT Pub. No.: WO2019/116067
PCT Pub. Date: Jun. 20, 2019

(65) Prior Publication Data

US 2020/0350734 A1 Nov. 5, 2020

(51) Int. Cl.
*H01R 13/6596* (2011.01)
*H01R 13/6581* (2011.01)
*H01R 13/66* (2006.01)

(52) U.S. Cl.
CPC ..... *H01R 13/6596* (2013.01); *H01R 13/6581* (2013.01); *H01R 13/665* (2013.01); *H01R 2201/26* (2013.01)

(58) Field of Classification Search
CPC ..... H01R 13/6569; H01R 13/6581; H01R 13/665; H01R 2201/26
(Continued)

(56) References Cited

U.S. PATENT DOCUMENTS 8,206,174 B2 * 6/2012 Ko ..... H01R 13/703 439/489
8,747,147 B2 * 6/2014 Yu ..... H01R 13/7031 439/489
(Continued)

FOREIGN PATENT DOCUMENTS

CN 201274358 Y 7/2009
CN 103986035 A 8/2014
(Continued)

OTHER PUBLICATIONS

International Search Report and Written Opinion dated May 11, 2018 in corresponding International PCT Application No. PCT/IB2017/001735, 10 pages.
(Continued)

*Primary Examiner* — Peter G Leigh
(74) *Attorney, Agent, or Firm* — Venable LLP; Jeffri A. Kaminski

(57) ABSTRACT

This electrical socket connector (6) includes a base portion, connection pins (30) arranged on an elongated portion (32) protruding from the base portion and a metallic ground shield (34) laterally surrounding the elongated portion (32). The ground shield (34) is divided between a first half (36) and a second half (38) which are separate and electrically insulated from each other.

4 Claims, 2 Drawing Sheets

(58) Field of Classification Search
USPC ..... 439/607.55
See application file for complete search history.

(56) References Cited

U.S. PATENT DOCUMENTS

| | | | | |
|---|---|---|---|---|
| 9,368,923 | B2 * | 6/2016 | O'Connor | H01R 13/7036 |
| 9,595,018 | B2 * | 3/2017 | Carvajal | H04W 4/027 |
| 10,205,257 | B1 | 2/2019 | Li et al. | |
| 2004/0161966 | A1 | 8/2004 | Benson | |
| 2007/0126290 | A1 * | 6/2007 | Jaynes | H02J 7/0044 307/150 |
| 2011/0281449 | A1 | 11/2011 | Ko | |
| 2013/0237085 | A1 * | 9/2013 | Kim | H01R 13/7031 439/357 |
| 2014/0120778 | A1 * | 5/2014 | Yu | H01R 13/7031 439/660 |
| 2015/0263461 | A1 | 9/2015 | O'Connor | |
| 2016/0093994 | A1 * | 3/2016 | Chen | H01R 12/724 439/607.01 |

FOREIGN PATENT DOCUMENTS

| | | | |
|---|---|---|---|
| CN | 105281382 | A | 1/2016 |
| CN | 109841991 | A | 6/2019 |

OTHER PUBLICATIONS

China Office Action dated May 28, 2021 in corresponding China Patent Application No. 201780097635.X, 14 pages.
China Office Action dated Dec. 15, 2020 in corresponding China Patent Application No. 201780097635.X, 16 pages.

* cited by examiner

ELECTRICAL SOCKET CONNECTOR AND VEHICLE COMPRISING THIS ELECTRICAL SOCKET CONNECTOR

CROSS-REFERENCE TO RELATED APPLICATIONS

This application is a U.S. National Stage application of PCT/IB2017/001735, filed Dec. 11, 2017, and published on Jun. 20, 2019, as WO 2019/116067 A1, all of which is hereby incorporated by reference in its entirety.

TECHNICAL FIELD OF THE INVENTION

The present invention relates to electrical connectors, and more particularly to Universal Serial Bus socket connectors. The invention also relates to a vehicle including an electrical socket connector.

BACKGROUND OF THE INVENTION

Electrical connectors, such as Universal Serial Bus (USB) socket connectors, are well known. They are used in many applications in order to provide connectivity between electronic devices. This connectivity is established by inserting a USB plug into a corresponding USB socket.

USB socket connectors are increasingly used as Direct-Current (DC) power delivery outlets. This is especially the case in vehicles, more particularly in automotive applications, where one or several USB sockets provide occupants with a simple and easy way to power and/or recharge their electronic devices.

Typically, USB sockets are associated to power converters which are arranged to deliver a conditioned voltage signal, such as a stabilized DC voltage. Quite often, these power converters are not permanently connected to a power grid. Instead, these power converters are supplied by a power source, such as a battery, which has a limited capacity. In other words, the power source can only provide a finite amount of energy before being depleted.

Because of this, in order to optimize power consumption, power converters are often configured to supply power to a USB socket only when a USB device is connected with this USB socket.

Various methods are known to detect if a USB device is connected to a USB socket. Some methods rely on a mechanical switch associated to the USB socket. Some other methods are software-based and may rely on a recurrent polling of data transmission lines connected to the USB socket.

A common drawback of these known methods is that they increase power consumption. They must be implemented by an electronic circuit continuously monitoring the connection status of the USB socket. This electronic circuit needs to be powered. As a result, the electronic circuit draws a residual electrical current from the power source, even when no USB device is connected. In some circumstances, this residual current may, over time, cause a depletion of the power source.

In many vehicles, the power source is the main battery of the vehicle. If this main battery is depleted, the vehicle may be rendered inoperative. This situation must be avoided.

SUMMARY OF THE INVENTION

The object of the present invention is therefore to provide an electrical socket connector able to solve the aforementioned drawbacks.

To that end, the invention relates to an electrical connector according to claim 1.

Owing to the invention, the first and second parts of the shell are electrically connected together only when a corresponding plug connector is inserted in the socket connector. The connection status of the USB connector can thus be easily detected without requiring an electronic circuit that needs to be electrically powered.

Additional embodiments, which are advantageous but not compulsory, are defined in the dependent claims 2 to 10.

BRIEF DESCRIPTION OF THE DRAWINGS

The invention will be better understood upon reading the following description, provided solely as an example, and made in reference to the appended drawings, in which.

DETAILED DESCRIPTION OF SOME EMBODIMENTS

Figure 1:
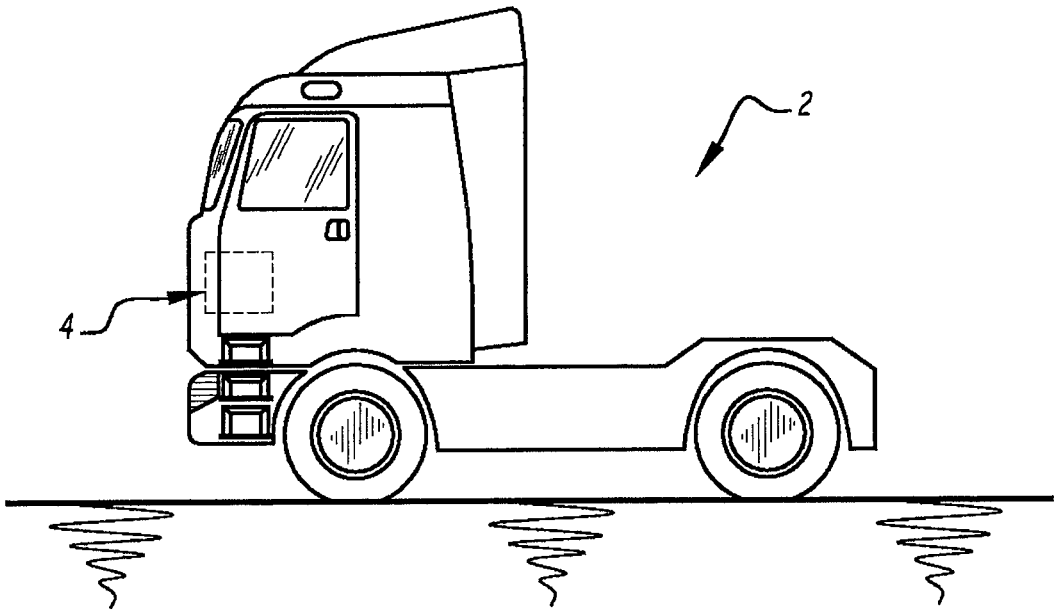
FIG. 1 is a simplified representation of a vehicle comprising an electrical circuit and an electrical connector according to embodiments of the invention.

FIG. 1 illustrates a vehicle 2 comprising an electrical circuit 4. In this example, the vehicle 2 is a semi-trailer truck which, in what follows, is simply referred to as "truck" and bears the reference 2.

However, the invention is not limited to a semi-trailer truck and can be applied more generally to any vehicle, preferably a wheeled industrial vehicle. Examples of industrial vehicles include tractors, dump trucks, military vehicles, heavy-duty construction vehicles such as loaders, bulldozers, excavators, compactors, scrapers, and the like.

More generally, the invention can be applied to any kind of vehicle, including aircrafts, boats and railway vehicles.

It is therefore understood that the semi-trailer truck 2 is merely an exemplary embodiment of a vehicle, and that the embodiments and advantages of the invention described in what follows can be adapted mutatis mutandis to other types of vehicles 2.

Figure 2:
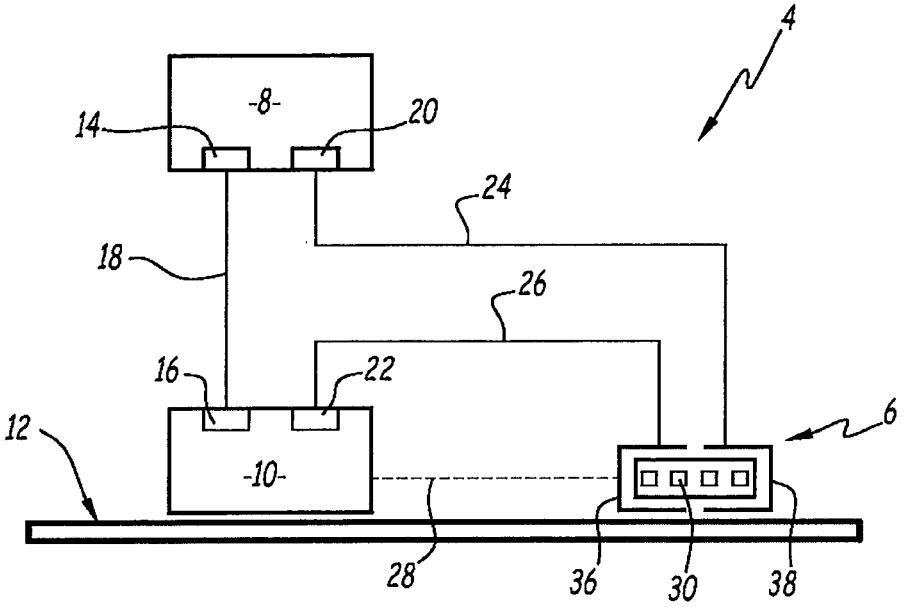
FIG. 2 is a simplified diagram of the electrical circuit of FIG. 1.

Embodiments of the electrical system 4 are described in reference to FIG. 2.

According to some embodiments, the electrical system 4 includes an electrical power source 8, a DC/DC power converter unit 10 and an electrical socket connector 6.

The socket connector 6 is adapted to be connected to a corresponding electrical connector plug (not illustrated) in order to establish connectivity between two electronic devices. For example, the connector 6 is connected and/or part of one of these electronic devices.

The connector 6 is also adapted to be used as a DC power delivery outlet. It is adapted to be electrically powered by the power source 8 through the intermediary of the power converter unit 10.

According to preferred embodiments, the connector 6 is a Universal Serial Bus socket connector.

For example, the dimensions and the connection pins arrangement are compatible with the specifications defined by the industry standards published by the "USB Implementers Forum", such as the USB 2.0 specification or the USB 3.0 specification or above.

In the illustrated example, the connector 6 is a "type A" USB socket connector. Other embodiments are possible, such as a "type C" USB socket connector. Other connector standards can be used.

Figure 3:
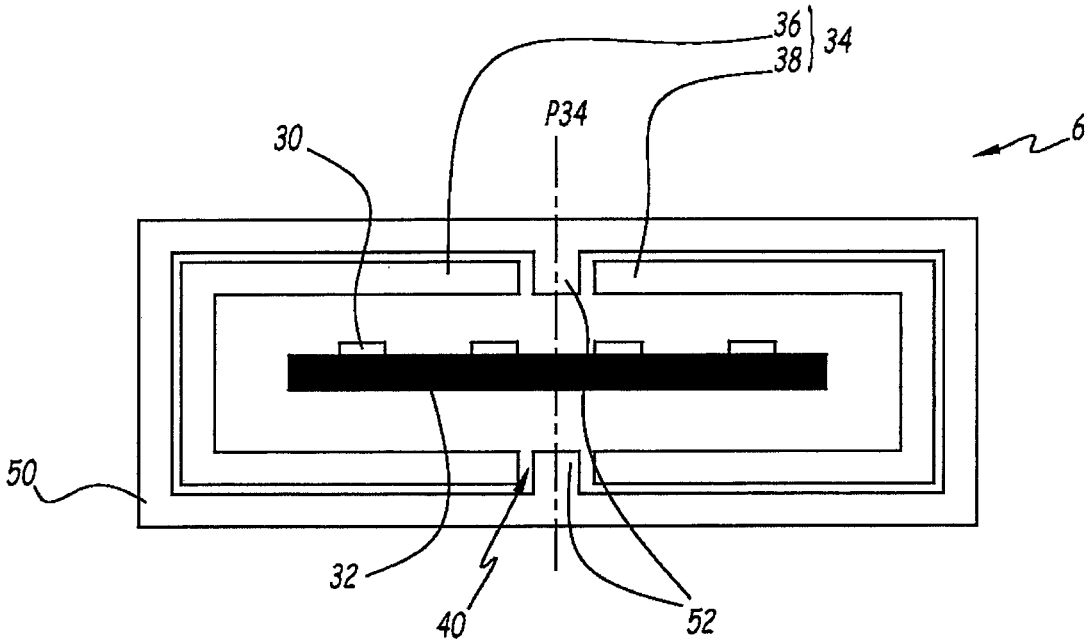
FIG. 3 is a simplified diagram of a front view of the electrical connector of FIG. 1.

As illustrated in FIG. 3, the connector 6 includes a base portion (not illustrated) a plurality of connection pins 30 arranged on an elongated portion 32 protruding from the base portion, and a metallic ground shield 34 laterally surrounding the elongated portion 32.

According to some embodiments, the base portion is part of a main body, or a frame, of the electrical connector 6. The base portion holds the components of the connector 6. For example, the base portion is made from a thermoplastic material.

For example, the elongated portion 32 extends along a longitudinal axis, for example perpendicular to the base portion. The ground shield radially surrounds the elongated portion 32 relative to the longitudinal axis. For example, the ground shield 34 extends from the base portion in parallel with the longitudinal axis. The insertion of a corresponding plug connector in the socket connector 6 is done by translation along the longitudinal axis.

In the illustrated example, the connector 6 includes four pins 30, two of these pins being adapted to deliver a voltage and the two other pins being connected to a data transmission line. Other embodiments are possible.

The ground shield 34 is divided between a first half 36 and a second half 38 which are separate and electrically insulated from each other.

For example, the ground shield 34 is made of two separate metallic parts, held together by the base portion.

It follows that there is no electrical connection between the first and second halves 36 and 38 when no connector plug is inserted inside the socket connector 6. However, the first and second halves 36 and 38 are electrically connected together when a corresponding connector plug is inserted inside the socket connector 6.

For example, this connection is performed thanks to a metallic ground shield of the socket connector 6, which comes into direct contact with the first and second halves 36 and 38 when the plug connector is inserted inside the socket connector 6.

In the embodiments where the connector 6 is a USB socket connector, then it is understood that the connector 6 is compatible with the USB specifications, except in that its ground shield 34 is divided in two parts. Therefore, the connector 6 is compatible with existing USB connector plugs and requires no modification of the USB connector plugs.

In this example, the transverse section of each first and second half 36, 38 of the ground case 34 has the shape of a U, for example of a U with a flat base.

In some embodiments, the first and second halves 36, 38 of the ground shield 34 are arranged symmetrically from each other relative to a symmetry plane P34 of the electrical socket connector 6.

In some further embodiments, the first and second halves 36, 38 of the ground shield 34 are identical to each other, except that they are arranged symmetrically as described. In other words, during manufacturing, the same parts can be used to form either a first half 36 or a second half 38. The connector 6 is therefore simpler to manufacture.

In the illustrated example, the symmetry plane P34 is arranged vertically. In alternative embodiments, the symmetry plane may be arranged horizontally. Preferably, the symmetry plane P34 extends in parallel with the above-mentioned longitudinal axis of the electrical connector 6.

However, other embodiments are possible. In some cases, the symmetry plane P34 is not necessarily horizontal or vertical, for example due to requirements of the manufacturing process. In some embodiments, the first half 36 and the second half 38 are split along an inclined separation plane and are arranged symmetrically relative to this separation plane.

In optional embodiments, the electrical socket connector 6 further includes an electrically insulating shield 50 surrounding the ground shield 34. More precisely, the insulating shield here radially surrounds the ground shield 34 relative to the longitudinal axis, while leaving a front face of the ground shield 34 free so as to allow insertion of a plug connector.

The insulating shield 50 is preferably made of a polymer material, such as a thermoplastic material.

In some embodiments, adjacent edges of the first and second halves 36, 38 of the ground shield 34 are separated from each other by a space 40. Then, the insulating shield 50 optionally further includes a protruding portion 52 extending into said space 40, so as to further insulate the first and second halves 36, 38 from each other. More precisely, the protruding portion 52 extends perpendicularly from an inner surface of the insulating shield 50, said surface being turned so as to directly face the ground shield 34.

In some alternative embodiments, the insulated shield 50 may be omitted.

Referring back to FIG. 2, the power source 8 is able to store a predefined amount of energy and to supply this energy to an electrical load. For example, the power source 8 is a rechargeable electrical battery or a supercapacitor array.

In some embodiments, the power source 8 is a main battery of the vehicle 2. In other words, in these embodiments, the power source 8 is adapted to electrically power additional devices in addition to the connector 6.

The power converter unit 10 is adapted to be supplied by the power source 8 and to deliver electrical power to the connector 6. For example, the power converter unit 10 receives a 12V DC voltage or a 24V DC voltage from the power source 8 and, in response, outputs a conditioned electrical voltage signal, such as a stabilized DC voltage. This voltage may be a 5V DC voltage.

In the illustrated example, at least some of the components of the electrical system 4 are mounted on a printed circuit board 12. Some of the electrical connections between elements of the electrical system 4 may be implemented using electrically conductive strips deposited on the circuit board 12. Other embodiments are however possible, in which the printed circuit board 12 is omitted.

The source 8 includes a voltage output which is meant to be connected to the power converter unit 10.

More precisely, the source 8 includes a voltage output terminal 14 connected to a voltage input terminal 16 of the power converter unit 10, for example using a first electrical connector 18, such as a wire or a conductive strip.

The source 8 also includes a ground output terminal 20 meant to be connected to a ground input terminal 22 of the power converter unit 10.

The first half 36 of the ground shield 34 is electrically connected to the ground input 22, here using a second electrical connector 26. Similarly, the second half 38 of the ground shield 34 is electrically connected to the ground output 20, here using a third electrical connector 24.

It follows that the ground output 20 and the ground input 22 can only be connected to each other through the first and second halves 36, 38 of the ground shield 34.

For example, the first and second halves 36, 38 are connected to the connectors 26 and 24, respectively, using soldering, or using a dedicated connection terminal.

One therefore understands that the first and second halves 36, 38 are each adapted to be connected to an electrical connector independently from the connection pins 30.

In addition, the power converter unit 10 is adapted to deliver power to the connector 6, more precisely, to deliver electrical power to connection pins 30 of the connector 6. For example, a power connection 28 links the output of the power converter unit 10 to at least some of the connection pins 30.

Moreover, the power converter 10 is adapted to deliver electrical power to the connector 6 only when its ground input 22 is electrically connected to the ground output 20 of the power source 8.

As a result, the connector 6 is powered by the power converter unit 10 only when a corresponding connection plug is connected, and ceases to be powered when the connection plug is removed, since the connection between the ground output 20 and the ground input 22 can occur only when a connection plug is inserted inside the connector 6.

Therefore, the invention provides a way for detecting the connection status of the connector 6 without drawing a residual current. The power consumption is reduced and the risk of accidentally depleting the power source 8 is lessened.

The embodiments of the USB connector 6 may be used independently from the vehicle 2. For example, the connector 6 and/or the electrical system 4 may be used in electronic devices, such as mobile communication devices or computers or electronic appliances.

The embodiments and alternatives described above may be combined with each other in order to generate new embodiments of the invention.

The invention claimed is:

1. An electrical system including an electrical power source, a DC/DC power converter unit adapted to be supplied by the power source and an electrical socket connector, wherein the power converter unit is adapted to deliver electrical power to the electrical socket connector, wherein the electrical socket connector includes a base portion, connection pins arranged on an elongated portion protruding from the base portion, a metallic ground shield laterally surrounding the elongated portion, wherein the ground shield is divided between a first half and a second half which are separate and electrically insulated from each other, wherein the first half of the ground shield is electrically connected to a ground input of the power converter unit, and wherein the second half of the ground shield is electrically connected to a ground output of the power source.

2. The electrical system of claim 1, wherein the power converter is adapted to deliver electrical power to the electrical socket connector only when its ground input is electrically connected to the ground output of the power source.

3. A vehicle, in particular an industrial vehicle such a semi-trailer truck, including an electrical system having an electrical socket connector for delivering a DC electrical current, wherein the electrical system is according to claim 1.

4. The vehicle of claim 3, wherein the electrical socket connector is arranged inside a driver cabin of the vehicle or inside a passenger compartment of the vehicle, so as to be accessible to occupants of the vehicle.

* * * * *